US005617969A

United States Patent [19]

Reichmann

[11] Patent Number: 5,617,969

[45] Date of Patent: Apr. 8, 1997

[54] SAFETY LOCK FOR CONTAINER CONNECTIONS

[75] Inventor: Hans-Helmut Reichmann, Burbach-Wahlbach, Germany

[73] Assignee: Schäfer Werke GmbH, Neunkirchen-Pfannenberg, Germany

[21] Appl. No.: 170,310

[22] PCT Filed: Apr. 29, 1993

[86] PCT No.: PCT/EP93/01028

§ 371 Date: Jan. 3, 1994

§ 102(e) Date: Jan. 3, 1994

[87] PCT Pub. No.: WO93/22208

PCT Pub. Date: Nov. 11, 1993

[30] Foreign Application Priority Data

May 2, 1992 [DE] Germany ..... 9205987 U

[51] Int. Cl.[6] ..... B65D 41/06

[52] U.S. Cl. ..... 220/295; 220/293; 220/300; 220/303; 220/319

[58] Field of Search ..... 220/293, 295, 220/300, 301, 303, 304, 319; 215/274, 279, 332, 356

[56] References Cited

U.S. PATENT DOCUMENTS 1,927,843 9/1933 Norquist .

5,150,803 9/1992 Caitellone ..... 215/357

FOREIGN PATENT DOCUMENTS

| | | |
|---|---|---|
| 0222736 | 5/1987 | European Pat. Off. . |
| 321539 | 1/1903 | France . |
| 196143 | 7/1905 | Germany . |
| 194799 | 2/1907 | Germany . |
| 114058 | 3/1918 | United Kingdom . |

*Primary Examiner*—Allan N. Shoap
*Assistant Examiner*—Stephen Cronin
*Attorney, Agent, or Firm*—Friedrich Kueffner

[57] ABSTRACT

In a safety lock for a container connection (3), at least two cams (9, 10) are arranged at the contacting surfaces of the container connection part (4) and lock part (5) and cooperate with a radially open groove (7) extending in the circumferential direction and with at least two axially parallel grooves (6 and 8) at the counterpart (5 or 4) in the manner of a bayonet catch. In order to obtain a safety lock system having a plurality of safe combination pairs which are absolutely safeguarded against interchanging, it is suggested that the combination pairs having a plurality of cams (9 and 10) and axially parallel grooves (6 and 8) at the container connection part (4) and at the lock part (5) have different circumferential (angular) distances (X1) from one another in the circumferential direction in a plurality of container connections of the same type.

6 Claims, 2 Drawing Sheets

SAFETY LOCK FOR CONTAINER CONNECTIONS

The invention is directed to a security lock or safety lock for container connections in which at least two cams are arranged at the contacting surfaces of the container connection part and the lock part and cooperate with a radially open groove extending in the circumferential direction and with at least two axially parallel longitudinal grooves at the complementary piece or counterpart in the manner of a bayonet catch.

Such safety locks are used on containers for which it must be ensured that only authorized persons in possession of the appropriate connection pieces fitting the safety lock in question may connect to the container, that is, have access to the contents of the container. For this purpose, a special tool is required, without which it is impossible to remove the lock part from the container connection part and thereby gain access to the contents of the container.

There are already a number of known constructions of such safety locks.

One such construction works with threads as connecting elements between the lock part and the container connection part.

The other construction uses a type of bayonet catch for mechanically connecting the lock part with the container connection part.

In both cases, unauthorized disconnection is prevented by a securing ring which can only be actuated by a special tool.

In the known safety lock of the latter type, i.e., in which the lock part is mechanically connected with the container connection part by a bayonet catch, the surface of the lock part contacting the container connection part has a radially open groove extending in the circumferential direction and two axially parallel longitudinal grooves of identical width which are arranged so as to be offset at a circumferential angle of 180° relative to one another and are thus located opposite one another at the circumference of the lock part. The two axially parallel longitudinal grooves proceed from opposite longitudinal edges of the radially open groove extending in the circumferential direction and cooperate with two cams which are arranged at the inner circumference or contacting surface of the container connection part and face toward the container axis and radially inward. These cams are also offset by 180° in the circumferential direction of the container connection part and are offset relative to one another parallel to the longitudinal axis of the container connection part at different heights of the latter.

In order to produce a number of noninterchangeable valve variants and container variants with safety locks of the type mentioned above for different applications, e.g. for chemicals on the one hand and beverages on the other hand, it has already been suggested to provide the cams and grooves of the safety locks for beverage containers with different, e.g. smaller, width dimensions than the cams and grooves on the safety locks for chemical containers. This ensures that the lock part of a safety lock for beverage containers having narrow grooves cannot be used in the container connection part of a chemical container having wide cams. But as a result, this would also prevent the filling of a chemical container in a beverage plant, since the connection pieces (tap heads) of the beverage plant would also not fit in the container connection part of the chemical container.

On the other hand, however, in the known safety locks the lock part and consequently also the connection piece (the tap head) for the chemical container with its wide grooves can be used in the container connection part of beverage containers with narrow grooves so that there still exists a considerable safety risk.

Thus, when using these known safety locks it is not possible to provide further safe variations of lock parts and container connection parts which can only be connected in the intended combination simply by changing the widths of the cams and grooves, since the lock part with the wider, axially parallel longitudinal grooves can always be inserted into the container connection part with the narrower grooves.

Therefore, the object of the invention is to suggest a system for safety locks of the known constructional type working in the manner of a bayonet catch which enables a large number of safe combination pairs which are safeguarded absolutely against interchanging without special or additional technical costs for manufacture.

Based on a safety lock for a container connection in which at least two cams are arranged at the contacting surfaces of the container connection part and lock part and cooperate with a radially open groove extending in the circumferential direction and with at least two axial grooves at the counterpart in the manner of a bayonet lock, this object is met in that the combination pairs having a plurality of cams and axially parallel grooves are arranged at different (angular) distances in the circumferential direction of the container connection part and lock part of a plurality of container connections which are identical in themselves. With such a design for a safety lock system, it is possible to produce a large number of noninterchangeable and incompatible combination pairs of lock parts and container connection parts for safety locks simply by appointing a suitable gradation of (angular) distances for the cams and the axially parallel longitudinal grooves in the circumferential direction of the contacting surfaces of the container connection part and the lock part. That is, when the circumferential distance between the axially parallel grooves in one functional part does not match the circumferential distance between the cams on the other functional part, these functional parts cannot be connected, at least cannot be guided into the required final position and accordingly cannot be fixed by the securing ring.

According to the inventive suggestion, it is possible to produce a large number of different combination pairs simply by variations in the circumferential distance. In so doing, it is not necessary to work with different widths of the grooves and cams, so that the costs for manufacturing and production means are minimal.

The number of incompatible combination pairs can be further increased, according to the invention, by arranging more than two cam pairs and groove pairs at every container connection part and lock part.

The container connection part can be constructed as a neck which is inserted into the lid or into the upper end wall of the container and the actual lock part can be inserted into this neck as a plug. However, this is only possible, according to the invention, when the cams have the same angular distance from one another, e.g. at the inner circumference of the neck in the circumferential direction, as the axially parallel grooves which are provided, for example, at the outer circumference of the plug. By means of a first axial movement of the plug, the first axially parallel groove of the plug is inserted over the first cam in the neck until this cam abuts against the upper edge of the radially open groove extending in the circumferential direction. The plug is then turned at an angle until it comes to rest with its second axially parallel groove over the second cam. Accordingly, the second cam can only enter the region of the first axial groove if the neck and plug match and are compatible. Only then is it possible to carry out a second axial movement of the plug in which the second axial groove achieves a positive engagement with the first cam so as to be fixed with respect to rotation relative to it and the first axial groove achieves a positive engagement with the second cam so as to be fixed with respect to rotation relative to it. In so doing, the lower end of the lock part acting as a plug encounters the elastic seal which is supported in a receptacle in the vicinity of the lower end of the container connection part designed as a neck. In so doing, this seal is elastically deformed until the spring ring, which is elastically flexible in the radial direction, engages with the two corresponding circumferential grooves of the plug and the neck in a locking connection which can only be detached with the help of a special tool. The spring ring advisably always sits in the circumferential groove of the plug, while it snaps into the circumferential groove of the neck so as to be detachable again.

Naturally, the principle of the inventive solution is also applicable when the cams are provided at the outer circumference of the plug and the axial grooves and the radially open groove extending in the circumferential direction are provided at the inner circumference of the neck.

An embodiment form of the subject matter of the invention is described in the following with reference to the drawings.

Figure 1:
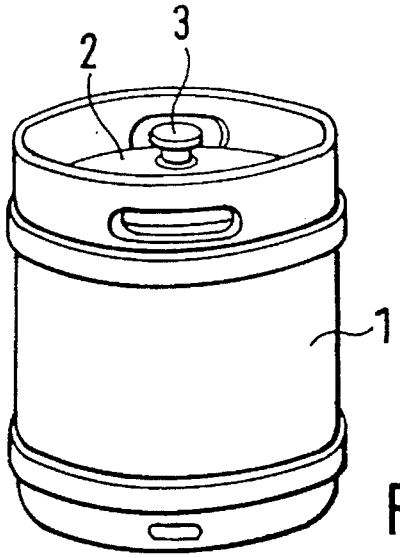
FIG. 1 shows a container provided with a safety lock.

FIG. 1 of the drawing shows, by way of example, a cylindrical container 1 which is provided with a safety lock 3 forming the actual container connection in its lid 2 which forms the upper end wall.

Figure 2:
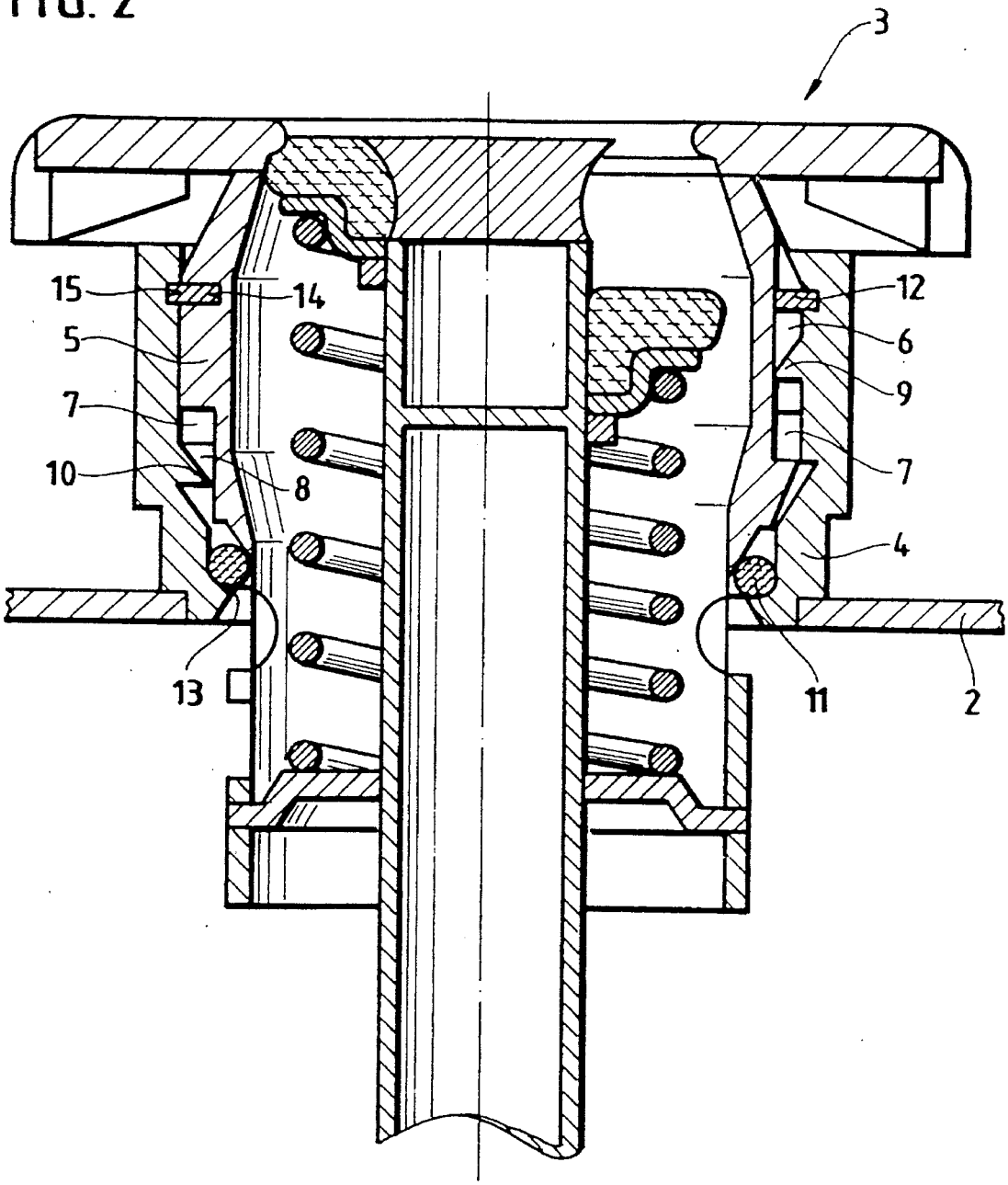
FIG. 2 is a sectional view in enlarged scale of the safety lock including a container connection part and a complementary lock part, the closed valve position being shown at left and the opened valve position on the right.

According to FIG. 2, the safety lock 3 or container connection has a container connection part 4 which is connected with the lid 2. A lock part 5 cooperates with this container connection part 4 to form the actual safety lock 3.

The lock part 5 has a radial circumferential groove 7 to which are connected an axially parallel groove 6 which is directed toward the outside of the container and an axially parallel groove 8 of the same depth which is directed toward the inside of the container.

In the locked state of the safety lock 3, a cam 9 which is pressed or molded inwardly from the container connection part 4 is located in the axially parallel groove 6 and a cam 10 which is pressed or molded inwardly from the container connection part 4 is located in the axially parallel groove 8. The cams 9 and 10 form a positive engagement with the grooves 6 and 8 so as to be fixed with respect to rotation relative thereto. A seal 11 is arranged between the container connection part and the lock part 5 in the region of the container connection part 4 close to the container. In order to keep the lock part 5 and the container connection part 4 in the locked position, a split spring ring 12 is arranged in the upper region of the safety lock 3. This spring ring 12 snaps into the corresponding circumferential grooves 14 and 15 of the lock part 5 and container connection part 4 when the locked position is achieved and accordingly secures this locked position in the axial direction.

The insertion of the lock part 5 in the container connection part 4 until the locked position is achieved is easily described with reference to the developed view of the contacting surfaces of the container connection part 4 and lock part 5 shown in FIG. 3. The lock part 5 is first inserted into the container connection part 4 and its axially parallel groove 8 is moved over the outer cam 9 by means of an axial movement until the latter contacts the outer edge of the radially open circumferentially extending groove 7. Since the radially open groove 7 is wider than the axial width of the cam 9, the lock part 5 in the container connection part 4 can be rotated by an angle X1 until the axially parallel groove 8 is positioned over the other cam 9. The lock part 5 can now be brought into the locked position by means of a further axial movement toward the inside of the container only on condition that the circumferential distance of the cams 9 and 10 and the circumferential distance of the axially parallel grooves 6 and 8 correspond to the dimension X1. In this locked position, the groove pairs 6, 9 and cam pairs 8, 10 form a radial positive engagement. In this locked position, the seal 11 takes effect and the spring ring 12 outwardly secures the lock part 5 against an axial movement in the container connection part 4.

Figure 3:
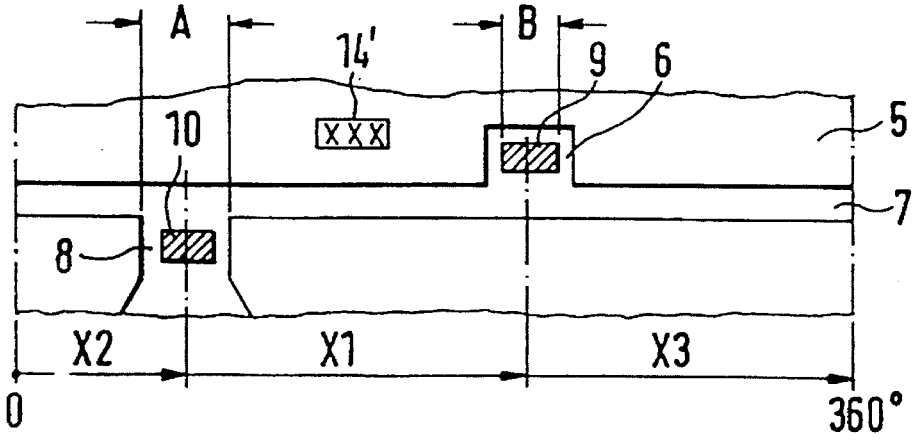
FIG. 3 shows a developed view of the contacting surfaces of the container connection part and lock part of the safety lock.

It is clear from FIG. 3 of the drawing that the cams 9 and 10 have a radial width B, while the axially parallel grooves 6 and 8 are provided with a width A. The width A of the axially parallel grooves 6 and 8 approximately corresponds to B+1 mm.

For a safety lock serving as a container connection, it is essential that the dimension X1 for the circumferential distances of the cams 9 and 10 and grooves 6 and 8 be designed differently from one combination pair to the other. For this purpose, the dimension X1 can be a minimum of approximately 15 mm, while the dimensional increments or steps for X1 can vary by roughly A/2, i.e. by half of the width A of the axially parallel grooves 6 and 8, from one combination pair to the next. Both the container connection part 4 and the lock part 5 are advisably provided with an identification marking 141 for the dimension X1 used in each instance.

A system of approximately 30 noninterchangeable combination pairs for safety locks of container connections can be developed in a simple manner by the suggested concept with a conventional diameter of approximately 40 mm for a container connection.

In the container connection shown in FIGS. 2 and 3 of the drawing, the container connection part 4 is constructed as a neck which is inserted into the lid 2 or upper end wall of the container 1 and in which the actual lock part 5 can be inserted in the manner of a plug. However, this is only possible if the cams 9 and 10 have the same distance X1 from one another at the inner circumference of the neck as the axially parallel grooves 6 and 8 at the outer circumference of the plug. By means of a first axial movement of the plug, the axially parallel groove 8 is first inserted over the cam 9 until the latter abuts at the upper edge of the radially open groove 7 extending in the circumferential direction. The plug is then rotated at an angle until its second axially parallel groove 6 comes to rest over the cam 9. Accordingly, the cam 10 can only attain the region of the first axial groove 8 if the neck 4 and the plug 5 match or are compatible. Only then is it possible to carry out a second axial movement to the plug 5, by which the axial groove 6 achieves a positive engagement with the cam 9 so as to be fixed with respect to rotation relative thereto and the axial groove 8 achieves a positive engagement with the cam 10 so as to be fixed with respect to rotation relative thereto. In so doing, the lower end of the lock part 5 acting as a plug encounters the elastic seal 11 which is supported in a receptacle in the vicinity of the lower end of the container connection 4 designed as a neck. In so doing, this seal 11 is elastically deformed until the elastically flexible spring ring 12 enters into a locking connection with the two corresponding circumferential grooves 14 and 15. One of the two circumferential grooves 14 and 15 is located at the outer circumference of the plug 5 and the other is located at the inner circumference of the neck 4. The spring ring 12 is advisably always arranged in the circumferential groove 14 of the plug 5, while it snaps into the circumferential groove 15 of the neck 4 and can be detached again only by means of a special tool.

The preceding description refers only to a container connection with a safety lock 3 in which the container connection part 4 and the lock part 5 can enter into a working connection with one another by the cooperation of two cams 9 and 10 and two axially parallel grooves 6 and 8. However, it also lies within the scope of the present invention to form combination pairs of container connection part 4 and lock part 5 which cooperate via more than two cams and more than two axially parallel grooves.

As an alternative to the described construction of a container connection with safety lock 3, it is also possible to provide the cams at the outer circumference of the lock part 5 acting as a plug and consequently to provide the axially parallel grooves and the circumferential groove connecting the latter at the inner circumference of the container connection 4 designed as a neck.

I claim:

1. A safety lock for a container connection in a container lid, the safety lock comprising an essentially tubular container connection part having an axis, and a lock part insertable in the container connection part, the container connection part having an inner circumferential surface and the lock part having an outer circumferential surface, wherein, when the lock part is inserted in the container connection part, the inner circumferential surface and the outer circumferential surface are in contact with each other, the lock part having a radially open circumferential groove and at least a first axial groove and a second axial groove extending parallel to the axis, the first and second axial grooves being in communication with the circumferential groove, wherein the first axial groove extends toward the container lid and the second axial groove extends away from the container lid, the container connection part having at least a first cam and a second cam, the first and second cams projecting radially inwardly and being spaced axially from each other, the first and second cams having an axial width smaller than an axial width of the circumferential groove, the first and second cams having a circumferential width smaller than a circumferential width of the first and second axial grooves, wherein the first and second cams are circumferentially spaced from each other by a spacing and the first and second axial grooves are circumferentially spaced from each other by a spacing, and wherein the spacing between the first and second cams and the spacing between the first and second axial grooves are equal, whereby, for locking the safety lock, the lock part is moved axially with the first cam being in engagement in the second axial groove until the first cam is received in the circumferential groove, the lock part and the container connection part are turned relative to each other until the first cam is in alignment with the first axial groove and the lock part is moved axially until the first cam is in engagement with the first axial groove.

2. The safety lock according to claim 1, comprising more than two pairs of first and second axial grooves and more than two pairs of first and second cams.

3. The safety lock according to claim 1, wherein the container connection part is a pipe section and the lock part is insertable into the pipe section in the manner of a plug.

4. A safety lock for a container connection in a container lid, the safety lock comprising an essentially tubular container connection part having an axis, and a lock part insertable in the container connection part, the container connection part having an inner circumferential surface and the lock part having an outer circumferential surface, wherein, when the lock part is inserted in the container connection part, the inner circumferential surface and the outer circumferential surface are in contact with each other, the container connection part having a radially open circumferential groove and at least a first axial groove and a second axial groove extending parallel to the axis, the first and second axial grooves being in communication with the circumferential groove, wherein the first axial groove extends toward the container lid and the second axial groove extends away from the container lid, the lock part having at least a first cam and a second cam, the first and second cams projecting radially outwardly and being spaced axially from each other, the first and second cams having an axial width smaller than an axial width of the circumferential groove, the first and second cams having a circumferential width smaller than a circumferential width of the first and second axial grooves, wherein the first and second cams are circumferentially spaced from each other by a spacing and the first and second axial grooves are circumferentially spaced from each other by a spacing, and wherein the spacing between the first and second cams and the spacing between the first and second axial grooves are equal, whereby, for locking the safety lock, the lock part is moved axially with the first cam being in engagement in the second axial groove until the first cam is received in the circumferential groove, the lock part and the container connection part are turned relative to each other until the first cam is in alignment with the first axial groove and the lock part is moved axially until the first cam is in engagement with the first axial groove.

5. The safety lock according to claim 4, comprising more than two pairs of first and second axial grooves and more than two pairs of first and second cams.

6. The safety lock according to claim 4, wherein the container connection part is a pipe section and the lock part is insertable into the pipe section in the manner of a plug.

* * * * *